US008491092B2

(12) United States Patent
McCoy et al.

(10) Patent No.: US 8,491,092 B2
(45) **Date of Patent: *Jul. 23, 2013**

(54) ROTARY INKJET IMAGING APPARATUS AND METHOD FOR PRINTING ON A STATIONARY PAGE OF MEDIA IN A CURVED CONFIGURATION

(75) Inventors: Donald Paul McCoy, Georgetown, KY (US); Mark Connelly Ott, Lexington, KY (US); David Charles Weatherly, Versailles, KY (US)

(73) Assignee: Funai Electric Co., Ltd. (JP)

( * ) Notice: Subject to any disclaimer, the term of this patent is extended or adjusted under 35 U.S.C. 154(b) by 36 days.

This patent is subject to a terminal disclaimer.

(21) Appl. No.: 13/185,564

(22) Filed: Jul. 19, 2011

(65) Prior Publication Data

US 2011/0267401 A1 Nov. 3, 2011

Related U.S. Application Data

(62) Division of application No. 12/187,002, filed on Aug. 6, 2008, now Pat. No. 8,001,893.

(51) Int. Cl.
*B41J 2/165* (2006.01)

(52) U.S. Cl.
USPC ..... 347/38

(58) Field of Classification Search
None
See application file for complete search history.

(56) References Cited

U.S. PATENT DOCUMENTS 8,001,893 B2 * 8/2011 McCoy et al. ..... 101/328

* cited by examiner

*Primary Examiner* — Matthew Luu
*Assistant Examiner* — Alejandro Valencia
(74) *Attorney, Agent, or Firm* — Amster, Rothstein & Ebenstein LLP

(57) ABSTRACT

A rotary inkjet imaging apparatus includes a curved print zone having a longitudinal axis and in which a page of media is held in a curved configuration at a stationary position, a carrier movable bi-directionally along a linear path defined adjacent to the curved print zone and extending parallel to the longitudinal axis thereof, and at least one inkjet printhead supported by the carrier for undergoing movement within the curved print zone along a curved path winding about a central axis extending parallel to the guide path and coaxial with the longitudinal axis of the curved print zone such that the inkjet printhead moves about the central axis multiple revolutions and prints on the page concurrently as the carrier unidirectionally moves along the linear path and the printhead moves within the curved print zone and through portions of the curved path in which the printhead faces toward the page.

8 Claims, 3 Drawing Sheets

ROTARY INKJET IMAGING APPARATUS AND METHOD FOR PRINTING ON A STATIONARY PAGE OF MEDIA IN A CURVED CONFIGURATION

This application claims priority and benefit as a divisional application of parent U.S. patent application Ser. No. 12/187,002, filed Aug. 6, 2008 now U.S. Pat. No. 8,001,893, having the same name.

BACKGROUND

1. Field of the Invention

The present invention relates generally to inkjet printing and, more particularly, to a rotary inkjet imaging apparatus and method for printing on a stationary page of media in a curved configuration.

2. Description of the Related Art

An imaging apparatus such as an inkjet printer, forms an image on a page of print media by ejecting ink from a plurality of ink jetting nozzles of an inkjet printhead to form a pattern of ink dots on the page. Such an inkjet printer typically includes a reciprocating printhead carrier that transports one or more inkjet printheads across the page along a bi-directional scanning path defining a print zone of the printer.

Market pressures continue to drive improvements in print speed and print quality. There are well-known barriers inhibiting the achievement of rapid printing of high quality inkjet images when using conventional swathing inkjet printheads. For instance, a significant fraction of total print time is dedicated to acceleration and deceleration of the printhead between printing passes. The necessity to camouflage systematic dot placement errors caused by printhead and motion control errors typically requires that each row of pixels (print grid cells) be printed with multiple nozzles. This in turn requires passing the printhead over a given row of pixels several times and advancing the page of media by a fraction of a swath height between passes. Total print time increases as the number of passes increases. Conventional swathing inkjet printers are susceptible to print quality problems due to the reciprocating motion. For example, printhead carrier vibrations during and after each acceleration induce dot placement errors. Reversal of the print direction in successive passes causes noticeable changes in dot shape so that two color tables are necessary for bi-directional printing. Ink dry time is comparable to the printhead turnaround time so dots from the immediately previous pass are wet at one end of the print swath and dry at the other end, a circumstance that can cause undesirable color effects. The paper feed mechanism is susceptible to advance distance variations both across the page width and between successive advances. The importance of paper feed inaccuracies has only increased as print speed requirements have driven manufacturers toward larger silicon printhead chips. All these errors contribute to color, grain, and banding defects.

An ideal multi-pass printhead would be one that achieves the following goals: (1) minimize non-printing time; (2) do multi-pass printing in the same time it takes to do single-pass printing, and (3) eliminate the motion control difficulties inherent in reciprocating printhead motion and incremental paper feed during printing. An ideal device that achieves these goals would be capable of a significant performance improvement compared to a conventional reciprocating printer.

One recent approach as an alternative to the conventional multi-pass swathing printhead is the provision of an inkjet drum printing arrangement in which a printhead moves linearly parallel to the axis of drum rotation as the drum rotates, causing image placement in a helical pattern on the drum after which, once the entire image is on the drum, a page of print media is rolled against the drum under pressure, causing transfer of the image to the page. This arrangement is disclosed in U.S. Pat. No. 7,052,125 assigned to the assignee of the present invention. While this alternative approach might be judged as a step in the direction toward achieving multi-pass printing as the printhead traverses the length of the drum once per page, it is more complicated than desired in view of the two-stage printing process.

Another alternative approach recently introduced in the marketplace is the provision of an array of multiple silicon printhead chips arranged to print a complete page width at once. In such a printer the print medium is fed continuously past the stationary page-wide printhead. High print speed can be achieved at the cost of a large number of silicon chips. This printing arrangement does not lend itself to multi-pass printing so it is susceptible to noticeable banding defects if one or more nozzles fail to jet properly.

Thus, there is still a need for an innovation that will have the potential to achieve the above-stated ideal goals.

SUMMARY OF THE INVENTION

The present invention meets this need by providing an innovation that takes additional steps beyond those exemplified by the first abovementioned alternative approach as well as beyond conventional swathing printheads. The innovation allows faster and higher quality multi-pass printing than conventional swathing printheads using a similar moderate number of nozzles. The innovation provides an apparatus having one or more printheads which print while concurrently moving generally in revolving paths along a stationary page within a generally curved print zone and, more particularly, moving in helical paths along a stationary page within a cylindrical print zone. Non-printing time is minimized because printhead motion is continuous and the printhead need not be decelerated and accelerated during printing, and because the printhead may be in position to print onto the print medium during a high fraction of the total print time. Print uniformity is enhanced because the motion control task simplifies to the accurate coordination of constant-velocity rotational and linear printhead motion. All printhead carrier acceleration/deceleration and paper feed accuracy issues inherent in the reciprocating design are avoided. Print uniformity is further enhanced because printing is unidirectional, hence the shift in the relative location of main and satellite dots typically observed in bi-directional printing is avoided and only one dot shape is made on the page. The imaging apparatus is mechanically simpler than the first abovementioned alternative approach because it prints the image directly onto the page and not on an intermediate transfer drum. If the inkjet nozzle arrays are arranged substantially parallel to the longitudinal axis of the helical motion then multi-pass printing may be accomplished in little or no additional time compared to one-pass printing with conventional reciprocating printers.

Accordingly, in an aspect of the present invention, a rotary inkjet imaging apparatus includes a curved print zone having a longitudinal axis and in which a page of media can be held in a curved configuration at a substantially stationary position about the axis, a carrier assembly including a carrier movable bi-directionally along a substantially linear path defined adjacent to the curved print zone and extending substantially parallel to the longitudinal axis thereof, and at least one inkjet printhead supported by the carrier for undergoing movement within the curved print zone along a curved path winding about a central axis extending parallel to the linear path and coaxial with the longitudinal axis of the curved print zone such that the inkjet printhead moves about the central axis multiple times and prints on the page concurrently as the carrier unidirectionally moves along the linear path and the printhead moves within the curved print zone and through portions of the curved path in which the printhead faces toward the page. In a particularly advantageous embodiment of the present invention, the inkjet nozzle arrays are arranged parallel to the longitudinal axis of the curved print zone.

In another aspect of the present invention, a rotary inkjet imaging method includes holding a page of media in a curved configuration at a stationary position in a curved print zone having a longitudinal axis, moving at least one inkjet printhead along a curved path winding multiple times about a central axis extending coaxial with the longitudinal axis of the curved print zone, and printing on the page by the printhead as the printhead undergoes the winding movement along at least a portion of the curved path when the printhead is facing toward the page and moving rotationally unidirectionally within the curved print zone.

BRIEF DESCRIPTION OF THE DRAWINGS

Figure 1:
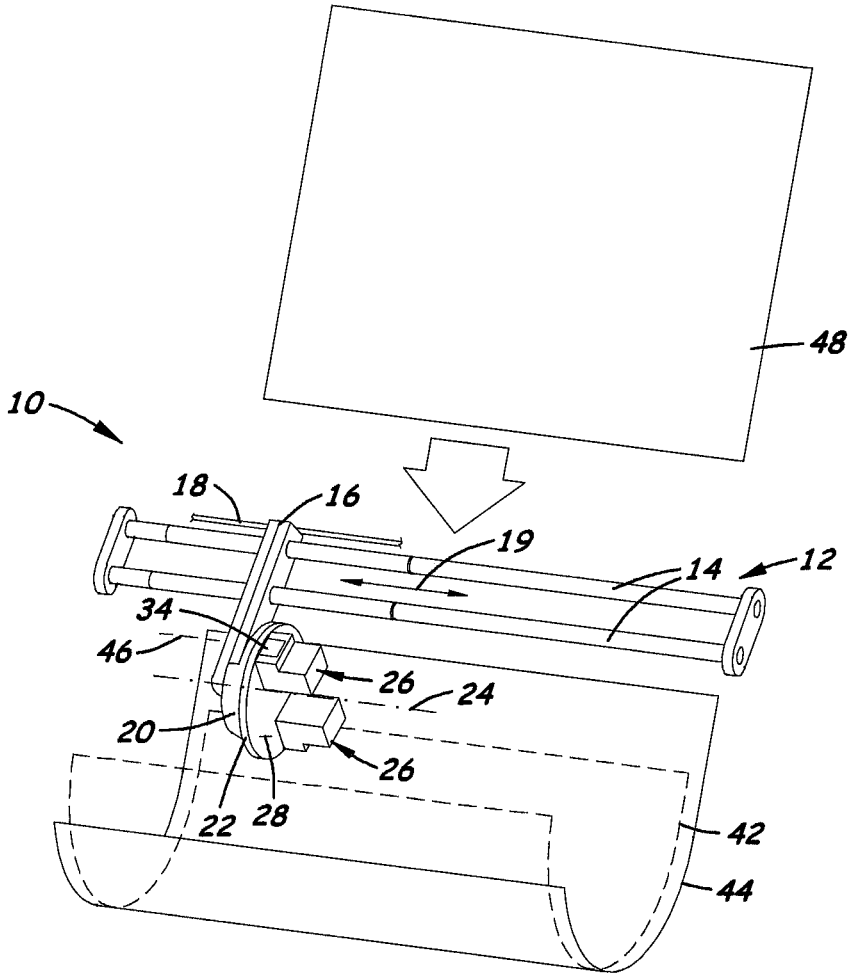

Having thus described the invention in general terms, reference will now be made to the accompanying drawings, which are not necessarily drawn to scale, and wherein:

FIG. 1 is a perspective view of an exemplary embodiment of a rotary inkjet imaging apparatus according to the present invention showing advancement of a page into a curved, for example substantially cylindrical, print zone of the apparatus where the page is held in a stationary position during printing.

Figure 2:
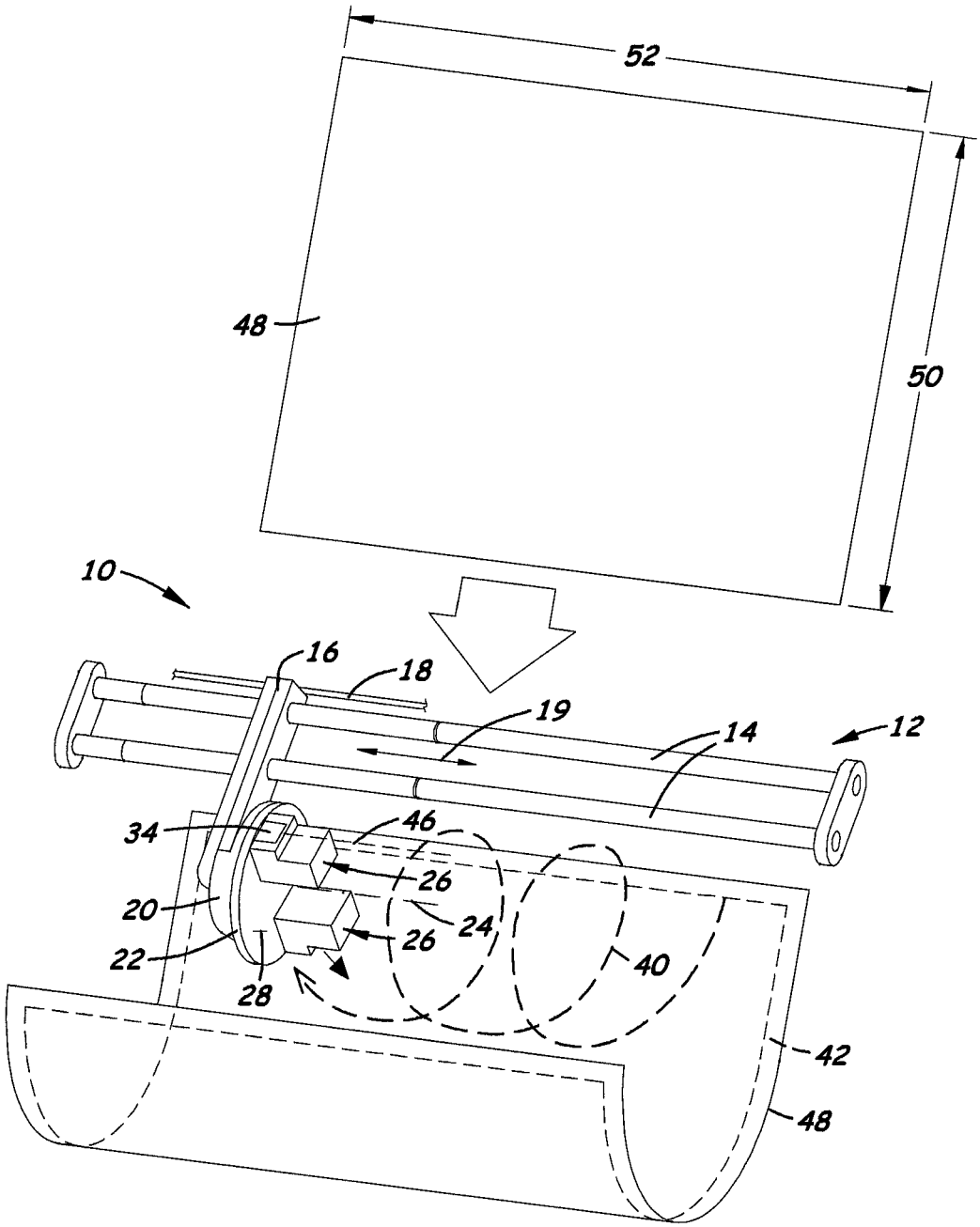

FIG. 2 is another perspective view of the rotary inkjet imaging apparatus with emphasis now on the way printheads of the apparatus concurrently revolve about a central axis along the stationary page and proceed axially through the curved print zone.

Figure 3:
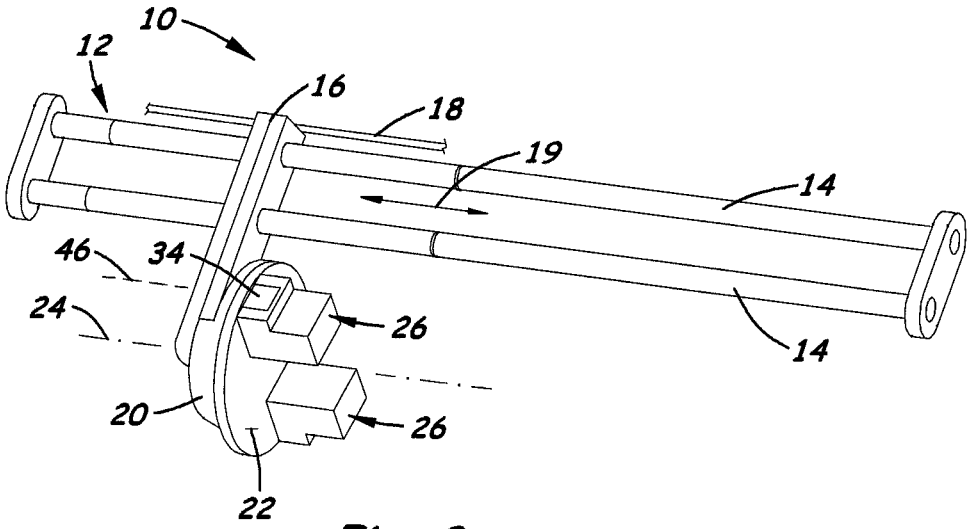

FIG. 3 is still another perspective view of the rotary inkjet imaging apparatus now highlighting the different components of the apparatus.

Figure 4:
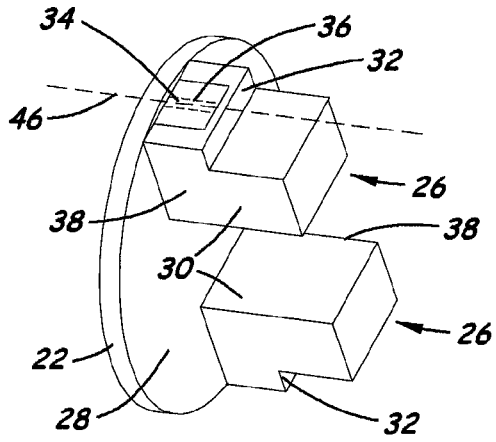

FIG. 4 is a perspective view of a printhead holding device of the apparatus removed from the platform of the apparatus.

Figure 5:
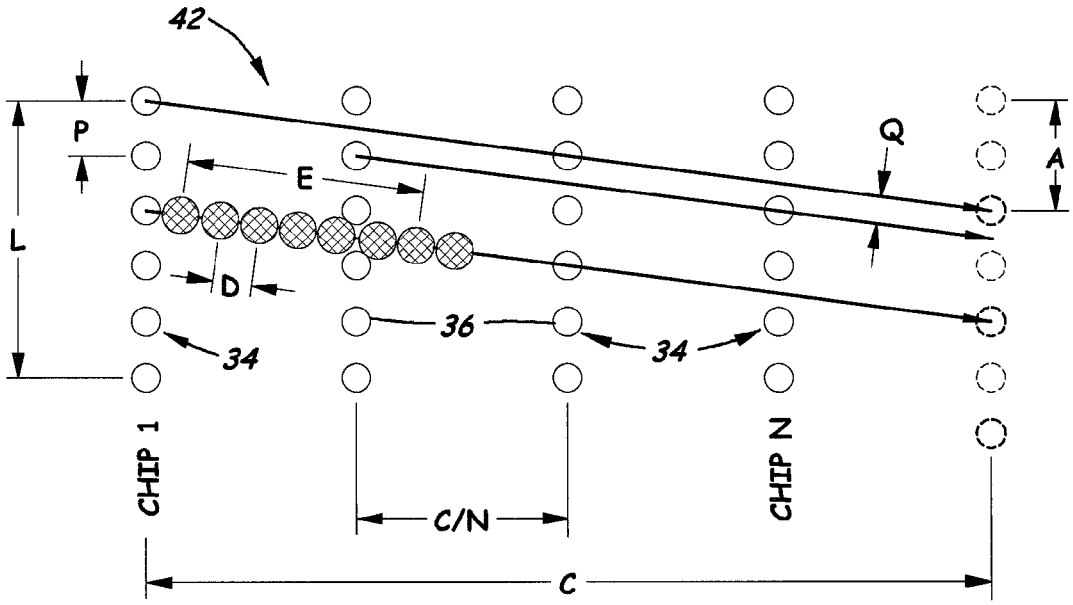

FIG. 5 is a layout of the semi-cylindrical print zone of the rotary inkjet imaging apparatus of the present invention unwrapped into a flat rectangular form to illustrate print grid and nozzle path relationship.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1-3, there is illustrated a rotary inkjet imaging apparatus, generally designated 10, in accordance with the present invention. The apparatus 10 includes a printhead carrier assembly 12 made up of a pair of stationarily-mounted guide members 14, which may be in the form of guide rods, disposed parallel to one another, a carrier 16 mounted for undergoing slideable movement along the guide members 14, and a transport belt 18 movably interconnecting the carrier 16 and a drive motor (not shown) for moving the carrier 16 reciprocally or bi-directionally along the guide members 14. While the carrier 16 is movable bi-directionally along substantially linear path 19, printing occurs only as the carrier 16 moves in one direction, or unidirectionally, as will become clear below.

The carrier 16 has fixedly mounted thereto a platform 20 which, in turn, mounts a holder device 22 for undergoing rotation about a central rotation axis 24. The holder device 22 supports one or more conventional mono or multi-color printheads 26 on a surface 28 of the holder device 22 facing away from the platform 20. The holder device 22 in the exemplary embodiment shown in FIGS. 1-3 has a substantially circular configuration. However, it may as readily have alternative configurations, for example, multiple arms extending radially outward from a central hub, with one printhead 26 mounted on an outer portion of each arm.

Each printhead 26 may take the form of an ink cartridge 30 and a module 32 attached to the cartridge 30 having an array 34 of ink jetting nozzles 36. The cartridge 30 contains ink used during a printing operation and supplies such ink to the nozzles 36. In the case of multiple printheads 26, the arrays 34 of nozzles 36 are spaced apart in a generally symmetrical or balanced relationship about the central axis 24 and the periphery of the holder device 22 with the cartridges 30 positioned inwardly of the modules 32. Each of the printheads 26 is removably and replaceably retained on the holder device 22 by a pivotal retainer cover 38, as seen in FIG. 4.

As the carrier 16 is slidably moved in a substantially linear path along the guide members 14, it carries with it the platform 20, holder device 22 and printheads 26. Concurrently, the holder device 22 is rotated and its printheads 26 rotated with it so as to revolve about the central rotational axis 24 such that each of the printheads 26, as a consequence is advanced along the guide members 14 in a generally curved path, and, in particular, a helical path 40, extending about the central rotational axis 24 which is coaxial with the longitudinal axis of a generally curved print zone 42 and, in particular, a substantially cylindrical print zone 42, defined by a suitable support structure 44 in the imaging apparatus 10. For ease of illustration in FIG. 2 the gap between the print zone 42 and printheads 26 is exaggerated. In actuality, the gap would be very small, only a few millimeters, the same as in the case of conventional inkjet printers. While the holder device 22 is rotating and advancing linearly about the central rotational axis 24 and the printheads 26 are moving along their respective helical paths 40 about and along the central rotational axis 24, the carrier 16 and platform 20 are only linearly driven along the guide members 14 through the length of the cylindrical print zone 42.

The non-rotating platform 20 contains suitable drive mechanisms and circuitry (not shown) for controlling the rotation of the printheads 26 and operation of their ejector nozzle arrays 34. Rotary and linear encoder strips (not shown) are provided on the holder device 22 and guide members 14 that locate the inkjet ejector nozzle arrays 34 relative to the print grid. Sensors (not shown) on the printheads 26 locate the page edges. Print data may be passed to the printheads 26 by means (not shown) consistent with high-speed rotation, for example, an optical link on the rotational axis, a wireless link, a slip ring or the like. In an embodiment, electric power is passed to the rotating holder device 22 from the platform 20 by a slip ring (not shown). Much of the drive components and control circuitry of the bi-directionally or reciprocally movable inkjet printer disclosed in U.S. Patent Application Publication No. 2006/0066656, assigned to the assignee of the present invention, are applicable also to the imaging apparatus 10. For this purpose, the disclosure of this publication is hereby incorporated herein by reference thereto.

Thus, the ink ejector arrays 34 of nozzles 36 of the inkjet printheads 26 are arranged and oriented to jet ink radially outward from array axes 46 extending substantially parallel to the central rotational axis 24 of the holder device 22 mounting the printheads 24. Inside of the printheads 26 and their ink cartridges 30 are ink compartments (not shown) such that each ink mass distributes itself during acceleration to high speeds so that the holder device 22 tends toward a balanced condition. The holder device 22 rotates and advances with the printheads 26 within the curved, cylindrical print zone 42. A sheet or page 48 is held stationary in a curved configuration within the cylindrical print zone 42 as the printheads 26 move along their respective helical paths 40, winding multiple times or revolutions about the central axis 24, across the width 50 of the page 48 while concurrently advancing along the length 52 of the page 48. Ink drops jet from their ejector nozzle arrays 34 onto the interior surface 48*a* of the curved stationary page 48 within the cylindrical print zone 42 during the portions of the helical paths 40 when the nozzle arrays 34 are facing toward the page 48 and as the carrier 16 moves along its substantially linear path in one direction only or unidirectionally relative to the print zone 42, such as from right to left as viewed in FIG. 2.

With reference now to FIG. 5, there is illustrated a layout of the semi-cylindrical print zone 42 of the rotary inkjet imaging apparatus 10 of the present invention unwrapped into a flat rectangular diagram for purposes of conceptual simplification to enhance clarity and aid understanding of the present invention. The diagram assumes that the nozzle array axes 46 are aligned parallel with the central axis 24 of the cylindrical print zone. The relationships among the rotational and advance speeds, the angle of print grid lines across the page of print media, and the number of nozzles that may be used to print a given print grid line will now be described. This will include selecting rotating and advancing speeds to allow multiple nozzles to print a given grid line at desired resolution while maintaining high jetting frequency for each nozzle. After layout, the helical paths which the nozzles traverse become straight lines that move across the print zone at an angle from the horizontal. The line spacing Q can be the ejector pitch (meaning the center-to-center spacing between ejectors) or, for example, one-half, one-third or one-fourth of the ejector pitch. The line angle depends on the distance the printhead advances axially per revolution.

The inclined nozzle paths or lines form the print grid with the nozzle paths being the same as the print grid lines. Each line can be populated with dots at any desired pitch. The identification of the variables is as follows:

A—advance per revolution; C—holder circumference; D—print grid line dot pitch;

E—nozzle ejection pitch; I—print grid lines per nozzle pitch; J—lowest integer number of nozzle pitches an array advances for any integer number of rotations K;

K—lowest integer number of rotations that advance the arrays by an integer number of nozzle pitches J; L—array length in units of nozzle pitch;

M—number of array nozzles; N—arrays on circumference; P—array nozzle pitch;

Q—print grid line spacing; R—holder radius at nozzle plate; $S_\theta$—scan (edge) speed;

$S_z$-axial advance speed; ω—rotation rate (rad/sec); f—jetting frequency; Y—number of arrays that print on a given print grid line during a set of K rotations; and T—total number of nozzles that print on a given print grid line.

The design starts with desired dot and line spacings D and Q, total number of nozzles that print a given print grid line (=number of passes) T, number of arrays N (per color), array length L, nozzle pitch P, circumference C, and desired jetting frequency f. Calculate allowable values for advance per revolution A and derive rotation rate ω, scan speed $S_\theta$ and advance speed $S_z$. The variables are related as follows:

1. Print grid line spacing Q=(P/I)cos(arctan (A/C)), where I is integer number of print grid lines per nozzle pitch P. Roughly, Q=(P/I), so choose I such that I≈P/Q.

2. Choose the lowest integer number of rotations K that advance the arrays by an integer number J of nozzle pitches such that KN/I=Y is an integer. Y is the number of arrays that print on a given print grid line during a set of K rotations.

3. Choose the integer number of nozzle pitches J that an array advances during a set of K rotations by J=int (YL/T).

4. The arrays advance J nozzle pitches during K rotations, so the advance distance per rotation is A=J/K in units of nozzle pitch, or A=(J/K)(P) in units of length.

5. Given dot spacing D and total nozzles T per print grid line, the ejection pitch E (=distance between ejections for a given nozzle) is E=DT.

6. Given desired jetting frequency f, edge speed is $S_\theta$=fE=fDT. Given desired edge speed $S_\theta$, jetting frequency is f=$S_\theta$/(DT).

7. Rotation speed is ω=2λ$S_\theta$/C in radians per second or ω=$S_\theta$/C in revolutions per sec.

8. Advance speed is $S_z$=$S_\theta$A/C.

9. Printing time per page=(page length)/($S_z$).

EXAMPLE ONE

Two inkjet chips with 312 nozzles per array at 1/600" pitch; desired print grid resolution is roughly (1/1200")×(1/1200"), total number of nozzles per print grid line is 16, jetting frequency=18 kHz, print zone circumference is 20": N=2; L=311; P=1/600"; Q=D=1/1200", T=16. Set I≈P/Q=2 print grid lines per nozzle pitch. Set the lowest integer number of rotations K that advance the arrays an integer number J of nozzle pitches. Choose K such that KN/I=Y is an integer. Since N=2 and I=2, set K=1, so Y=1 also. Then set the integer number of nozzle pitches J the arrays advance during a set of K rotations so that T total nozzles pass over a given print grid line: J=int (YL/T)=int ((1)(311)/(16))=19. Then the advance distance A per rotation is J/K nozzle pitches or JP/K=(19)(1/600)/(1)=0.03167 in. For 1/1200" dot spacing, 16 nozzles per print grid line, and 18 kHz jetting frequency, the rotation edge speed is $S_\theta$=fDT=(18000)(1/1200)(16)=240 in/s. For circumference C=20 in, the rotation speed is ω=$S_\theta$/C=240/20=12 rev/s. The advance speed is $S_z$=$S_\theta$A/C=(240)(0.03167)/(20)=0.38 in/s. Printing time per 12 inch page=12/0.38=31.6 sec.

EXAMPLE TWO

For T=8 nozzles per print grid line, choose J=int (YL/T)=int ((1)(311)/(8))=38 and the advance distance A per rotation is J/K nozzle pitches or JP/K=(38)(1/600)/(1)=0.06333 in. For 1/1200" dot spacing, 8 nozzles per print grid line, and 18 kHz jetting frequency, the rotation edge speed is $S_\theta$=fDT=(18000)(1/1200)(8)=120 in/s. For circumference C=20 in, the rotation speed is ω=$S_\theta$/C=120/20=6 rev/s. The advance speed is $S_z$=$S_\theta$A/C=(120)(0.06333)/(20)=0.38 in/s as before. Printing time per 12 inch page=12/0.38=31.6 sec.

Note that in both these examples the print zone circumference is 20 inches so that two pages can be printed at once. The effective print time for each 1200×1200 dpi page with two such inkjet chips at 18 kHz is 15.8 sec, which is quite fast for this grid resolution.

Compare the foregoing with conventional 8-pass printing with the two chips: Assume the two 600 dpi chips are ganged to make an effective 1200 dpi array. The print swath is (311)(1/600)=0.518 inch. For 8-pass, advance the paper 0.518/8 inch=0.0648 inch per swath, but pass over each swath twice to get 1200 dpi in the scan direction. Maximum swath speed is 30 in/sec. For 8.5 inch swath, print time per swath is 8.5/30=283 ms. For turnaround time, add deceleration and acceleration at 1.5 g=(2)(30)/(1.5)(32.2)(12)=104 ms. Total time for a print pass is 283 ms+104 ms=387 ms. For 12 inch page length, number of swaths is (2)(12.0/0.0648)=370 swaths. At 387 ms per pass and two passes per swath, the conventional printing time for one page is 286 seconds, about 18 times the effective print time per page with the printhead of above Examples One and Two as used in the rotary imaging apparatus 10 of the present invention.

Multi-pass printing may be achieved, in effect, if the ejector arrays advance along the length of the page less than one array length per revolution. In that case a set of several nozzles passes over each print grid line and that print grid line may be printed with that set or a subset of the nozzles chosen randomly. Print speed is maximized because the printhead rotation and advance speeds can be adjusted so that the ejectors operate at rated fluidic frequency, maximizing paint rate even while printing each grid line with multiple nozzles. The surprising result is that multi-pass printing can be done in the same amount of time as single-pass printing. As just seen, the effective paint rate in multi-pass printing by the rotary inkjet imaging apparatus 10 of the present invention can be greatly increased compared to conventional swathing printing.

It will be apparent to those of ordinary skill in the art that the inkjet printheads 26 of the rotary inkjet imaging apparatus 10 of the present invention may utilize diverse technologies, such as thermal, pressurized nozzles, electrostatic fields and/or piezoelectric elements.

Further, the foregoing description of one or more embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A rotary inkjet imaging method, comprising:

holding a page of media in a curved configuration in a curved print zone having a longitudinal axis;

moving at least one inkjet printhead along a curved path winding multiple revolutions about a central axis extending coaxial with the longitudinal axis of the curved print zone; and printing on the page by the printhead as the printhead undergoes the winding movement along at least a portion of the curved path when the printhead is facing toward the page and moving unidirectionally within the curved print zone.

2. The method of claim 1, wherein said moving at least one inkjet printhead includes moving a plurality of inkjet printheads along curved paths in generally symmetrical relationship with respect to each other about the central axis.

3. The method of claim 1, wherein said holding a page of media in a curved configuration includes holding the page in a substantially cylindrical configuration in a substantially cylindrical print zone.

4. The method of claim 1, further comprising:

bi-directionally moving a carrier along a linear path defined adjacent to the curved print zone and extending substantially parallel to the longitudinal axis thereof and substantially parallel to the central axis of the curved path of movement of the printhead.

5. The method of claim 4 further comprising:

rotating a holder device rotatably supported by the carrier and supporting the inkjet printhead so as to cause the movement of the printhead in the curved path about the central axis and relative to the carrier.

6. The method of claim 4 wherein said bi-directionally moving the carrier includes unidirectionally moving the carrier along the linear path during printing by the printhead.

7. A rotary inkjet imaging method, comprising:

holding stationary a page of media in a curved configuration to define a curved print zone about a longitudinal axis, wherein the page of media has a length and width dimension;

providing a carrier assembly including a carrier movable bi-directionally along a substantially linear path that extends substantially parallel to said longitudinal axis, the carrier rotatingly connected to at least one inkjet printhead;

moving the carrier along said linear path at an advance speed past the page of media; and rotating the at least one inkjet printhead at a rotation speed through said curved print zone along a curved path that winds about a central axis substantially coaxial with the longitudinal axis of the curved print zone such that said inkjet printhead moves across the length and width dimension of the stationarily held page of media in a single pass of the carrier past the page of media, the rotating including winding the at least one inkjet printhead multiple times about said central axis to image an entirety of the page of media.

8. The method of claim 7, wherein the at least one inkjet printhead has an ejector array of nozzles of a given length, further including advancing the ejector array past the length dimension of the page of media at a rate of less than one given length per winding of the at least one inkjet printhead about the central axis.

* * * * *